United States Patent [19]

Marosy

[11] 4,184,232

[45] Jan. 22, 1980

[54] COUPLING

[76] Inventor: Andre Marosy, 16249 Hilton, Southfield, Mich. 48075

[21] Appl. No.: 905,514

[22] Filed: May 15, 1978

[51] Int. Cl.[2] ..... A44B 17/00

[52] U.S. Cl. ..... 24/201 A; 24/230 TC; 24/221 R

[58] Field of Search ..... 24/201 A, 201 R, 230 TC, 24/221 R; 403/348

[56] References Cited

U.S. PATENT DOCUMENTS

| | | | |
|---|---|---|---|
| 256,755 | 4/1882 | Spangler | 24/201 A |
| 2,203,973 | 6/1940 | Walls | 24/221 R |
| 2,220,810 | 11/1940 | Bright | 24/221 R |
| 3,286,316 | 11/1966 | Marosy | 24/221 R |
| 3,427,552 | 2/1969 | Sauer | 24/221 R |
| 3,540,087 | 11/1970 | Marosy | 24/221 R |
| 3,540,091 | 11/1970 | Marosy | 24/221 R |
| 3,900,927 | 8/1975 | D'Angelo | 24/201 R |

FOREIGN PATENT DOCUMENTS

| | | | |
|---|---|---|---|
| 26617 | 4/1884 | Fed. Rep. of Germany | 24/201 R |

*Primary Examiner*—Bernard A. Gelak
*Attorney, Agent, or Firm*—Hauke and Patalidis

[57] ABSTRACT

A quick connect and disconnect coupling for connecting the free ends of chains, wires or cables and more particularly for connecting the free ends of pieces of jewelry such as bracelets, chain bracelets, neck chains, necklaces and the like. The coupling of the invention comprises a male member having a T-shaped element which is adapted to be introduced into a slotted aperture in the end plate of a female member. A pair of flat springs disposed in the female member engages the branches of the T-shaped element and resiliently rotate the male member such that the projecting lateral ears of the T-shaped element are engaged behind the end plate of the female member. For disconnecting the coupling, the male and female members are rotated relative to each other, against the torque exerted by the springs, until the laterally projecting ears of the T-shaped element registers with the slot in the female member end plate and the male member may be removed from the female member.

4 Claims, 7 Drawing Figures

FIG. 1
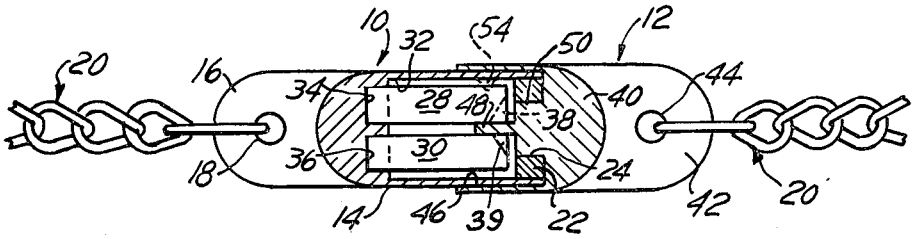
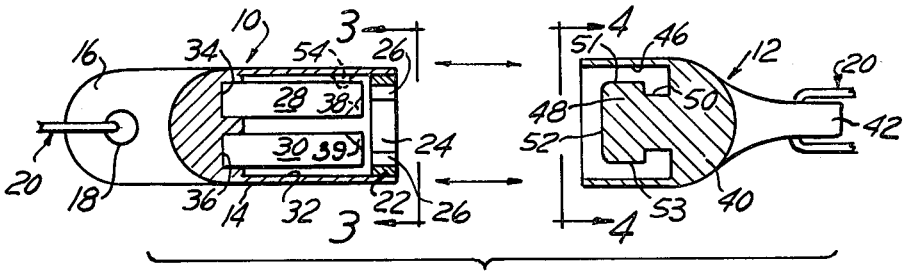
FIG. 2
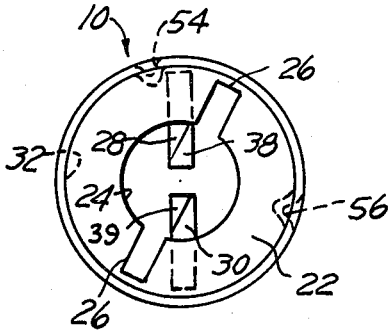
FIG. 3
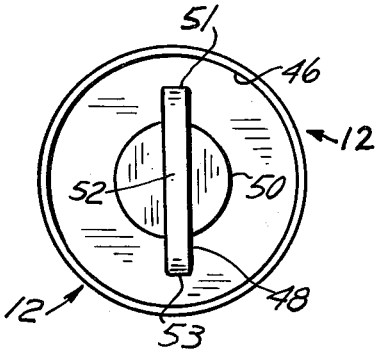
FIG. 4

COUPLING

BACKGROUND OF THE INVENTION

The present invention relates to a quick connect and disconnect coupling particularly well adapted as a coupling for pieces of jewelry and the like.

Many couplings have been devised in the past for connecting together the free ends of a piece of jewelry such as a bracelet, a neck chain, a waist chain, a necklace and the like. Such couplings are generally in the form of spring clasps, split rings, with spring-biased pins, and the like. Such couplings must, of necessity in order to avoid detracting from the aesthetic appearance of the piece of jewelry, be made in a relatively small size, and be as inconspicuous as feasible. On the other hand the couplings must be sturdy and they must not be subject to accidental disconnect, while still providing great ease of connect and disconnect. The couplings must be able to withstand repeated use, and sometimes abuse, without failure and they must structurally be as strong as the chain, bracelet or other piece of jewelry of which they form a part.

The various requirements that jewelry couplings must meet are therefore somewhat contradictory. A jewelry coupling must be of small size, which makes it difficult to manufacture with a reasonable degree of sturdiness, and it must be made with sufficient precision such that its operation is practically foolproof. It is therefore advantageous to make the coupling as simple as possible, with as few parts as convenient in order to reduce the manufacturing costs and the risks of malfunction.

The present invention provides a simple coupling, which can be made as small as desired, which is relatively easy to manufacture, which comprises only two moving parts, the male member and the female member of the coupling, which locks simply by pushing the male portion into the female portion, which unlocks simply by rotating the two members relative to each other, and which can be manufactured at relatively low cost.

SUMMARY

The present invention accomplishes its objects by providing a coupling structure consisting of a male member and a female member, the male member having a T-shaped tongue or key insertable through a slot formed in the end plate of the female member, the female member being provided internally with a pair of parallel leaf springs the end of which are slidably engageable by the male member T-shaped tongue and deflected such that the T-shaped tongue is automatically rotated by the springs resuming their original position, with the result that the ends of the branches of the male member T-shaped tongue is engaged under the imperforate portion of the end plate of the female member, thus locking the male member to the female member.

The many objects and advantages of the present invention will become apparent to those skilled in the art when the following description of the best mode contemplated for practicing the invention is read in conjunction with the accompanying drawing wherein:

BRIEF DESCRIPTION OF THE DRAWINGS

FIG. 1 is a view of a coupling according to the present invention shown in a locked position and with portions broken away to illustrate the internal construction;

FIG. 2 is a view similar to FIG. 1 but showing the two halves of the coupling disconnected;

FIG. 3 is an end view of the female member of the coupling of FIGS. 1–2 as seen from line 3—3 of FIG. 2;

FIG. 4 is an end view of the male member of the coupling of FIGS. 1–2 as seen from line 4—4 of FIG. 2;

DETAILED DESCRIPTION OF THE PREFERRED EMBODIMENT

Figure 5:
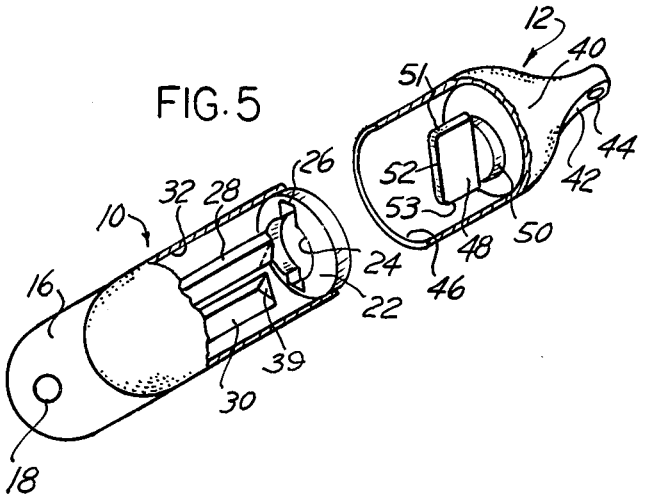
FIG. 5 is a perspective view of the coupling of the invention shown with the female and male members disconnected, and with portions broken away.

Referring to FIGS. 1–4, an example of coupling according to the present invention comprises a female member 10 shown at FIG. 1 connected with a male member 12 and, at FIG. 2, disconnected therefrom. The female member 10 comprises a generally cylindrical housing 14 having a flattened end 16 provided with an aperture 18 for mounting therethrough the end link of a piece of jewelry 20, such as a bracelet, neck chain, necklace, or the like. The housing 14 is preferably made of a precious metal such as silver, gold or the like, matching the metal of the piece of jewelry 20 whose ends are connected by means of the coupling of the invention. The housing 14 is provided with an end plate 22, best shown at FIG. 3, fastened in place such as by soldering, or by crimping of the rim of the open end of the housing 14 over the edge of the end plate. The end plate 22 has a centrally disposed circular aperture 24 provided with a diametrally disposed slot 26. A pair of substantially parallel co-planar separate leaf spring blades 28 and 30 are mounted in an internal cavity or bore 32 disposed in the housing 14, as a result of the end of each spring blade being press-fitted, cemented, soldered, or otherwise fastened in each of a pair of appropriate holding cavities 34 and 36 formed at the bottom of the housing bore 32. Alternatively, the spring blades 28 and 30 may be made in a single integral part having a root portion extending through the flattened end portion 16 of the housing 14 and crimped therein, the aperture 18 being also formed through the common root portion of the spring blades. The free ends of the spring blades 28 and 30 are provided with oppositely inclined tapered camming surfaces 38 and 40, respectively, and the common plane of symmetry of the two spring blades 28 and 30 is disposed a few degrees away from the position of the axis of the slot 26 in the end plate 22, as best shown at FIG. 3.

The male member 12 of the coupling has a housing 40 having a flattened end 42 provided with an aperture 44 for attachment therethrough of the other end of the neck chain, necklace, bracelet or like piece of jewelry 20. The other end of the housing 40 forms a recess 46 defining a guiding means and having an internal diameter slightly larger than the outside diameter of the female member housing 14 for accepting the free end of the female member 10 therein, when the two members of the coupling are connected, as shown at FIG. 1. Within the recess 46 of the male member 12 is mounted a T-shaped element in the form of a flat rectangular key or tongue member 48 insertable through the slot 26 in the end plate 22 of the female member 10, the tongue member 48 being supported by a cylindrical base 50 of a diameter fitting the internal diameter of the circular aperture 24 in the end plate 22 of the female member 10. The cylindrical base 50 has a height slightly larger than the thickness of the end plate 22 in the female member 10. The key or tongue member 48 has a rounded or tapered leading edge 52 and forms a pair of lateral ear sections 51 and 53 extending beyond the periphery of the cylindrical support base 50.

The housing 14 of the female member 10 has a pair of dimples 54 and 56 projecting on the interior surface of the bore 32, and angularly disposed as best shown at FIG. 3 limiting, respectively, the deflection of the spring blade 28, for example, when the tongue 48 of the male member 12 is introduced through the slot 26 in the end wall 22 of the female member 10, and the amount of rotation of the male member relative to the female member when the two members are coupled together as shown at FIG. 1.

Figure 6:
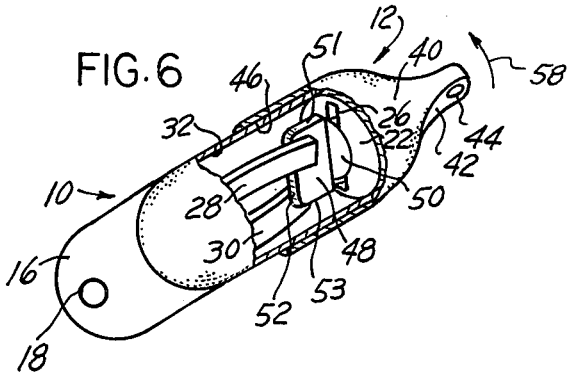
FIGS. 6 and 7 are views similar to FIG. 5 but showing a progression of the relative engagement between the elements, during coupling of the female member with the male member.
Figure 7:
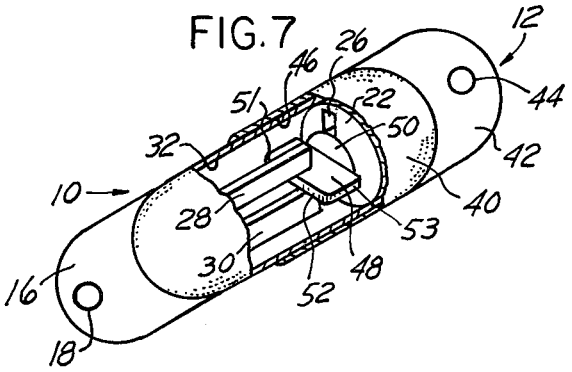

FIGS. 5–7 graphically illustrate the operation of the coupling of the invention, from the uncoupled mode, FIG. 5, to the coupled and locked mode, FIG. 7. For coupling the male member 12 to the female member 10, the tongue member 48 of the male member 12 is introduced through the slot 26 in the end plate 22 of the female member 10. The leading edge 52 of the tongue member 48 progressively engages the camming surfaces 38 and 40 of the spring blades 28 and 30, such that the spring blades are resiliently deflected in opposite directions as illustrated at FIG. 6, with the tongue member 48 introduced therebetween and the cylindrical base 50 disposed in the circular aperture 24 in the female member end plate 22. The positioning of the end of the spring blades 28 and 30 relative to the axis of the slot 26 is such that the space between the opposite camming surfaces 38 and 40 is oriented the same as the position of the tip or leading edge 52 of the tongue member 48 when the tongue member is introduced through the slot 26. Further penetration of the male member by the tongue member 48 beyond the end plate 22 of the female member 10 progressively bends the ends of the spring blades 28 and 30 in opposite directions. The spring blades 28 and 30 thus exert a torque on the lateral ear sections of the tongue member 48 which automatically rotates the male member 12 relative to the female member 10, even though only two fingers of a hand may be used to apply a slight pressure on the free ends of the female member 10 and male member 12 in opposite directions. As the cylindrical base 50 supporting the tongue member 48 is slightly higher than the thickness of the end plate 22, the trailing edge of the tongue member 48 clears the inside surface of the female member end plate 22, such that the male member 12 is free to rotate relative to the female member 10, around the longitudinal axis of the assembly, in the direction of the arrow 58, FIG. 6. The spring blades 28 and 30 resiliently resume their normal co-planar position, thus forcing the male member 12 to rotate relative to the female member 10 approximately 90°, to the locked position shown at FIG. 7. In such locked position the tongue member 48 is disposed substantially at a right angle to the plane of the spring blades 28 and 30, the thickness of the tongue member 48 being equal or less than the space separating the spring blades 28 and 30. In that position, one of the laterally projecting ear portions, 51 or 53, of the tongue member 48 engages the crimped projection 50 on the inside surface of the bore 32 of the female member 10 and the laterally projecting ear portions 51 and 53 are disposed behind the female member end plate 22, thus preventing the female and male members 10 and 12 from being pulled apart.

In order to uncouple the female member 10 from the male member 12, the two members are manually rotated relative to each other around their longitudinal axis to the position of FIG. 6. In such position, one side of the spring blade 28 abuts against the projection 54 on the surface of the female housing bore 32, thus preventing the spring blade 28, and consequently the spring blade 30, to be deflected beyond a certain amount and the tongue member 48 from being rotated beyond the position in which it registers with the slot 26 in the end plate 22, such as to enable the male member 12 to disengage from the female member 10. The male member 12 tends to automatically pop away from the female member 10 in view of the resultant force in a longitudinal direction exerted by the spring blades 28 and 30 and their camming surfaces 38–40 againstthe leading edge 52 of the tongue member 48, if the spring blades 28 and 30 are made stiff enough.

Although the coupling of the present invention has been described as a coupling for uniting the two free ends of a pliable piece of jewelry such as a neck chain, a necklace, a bracelet or the like, it will be readily apparent that the structure and the principle of the coupling of the invention can be manufactured at low cost, in any type of material, such as metal, plastic and the like, and in any size which is convenient, and for any type of application, including industrial applications.

Having thus described the present invention by way of an example of structural embodiment thereof, modifications whereof will be apparent to those skilled in the art, what is claimed as new is as follows:

1. A coupling comprising a male and a female members, said male member comprising an end having a generally T-shaped member and said female member comprising a housing having a cavity closed by an end plate, a slot through said end plate accepting said T-shaped member of said male member, and spring bias means within said cavity urging said T-shaped member in rotation relative to said slot for locking said T-shaped member in said cavity below said end plate out of registry with said slot, wherein said T-shaped member comprises a substantially rectangular tongue member supported by a cylindrical base and the end plate of said female member comprises a circular aperture having a diameter slightly larger than the diameter of said cylindrical base, and wherein said spring bias means comprises a pair of substantially co-planar separate spring blades extending longitudinally in said housing and having an end fastened at the bottom of said cavity in said housing, each of said spring blades having a free end extending proximate said end plate substantially in registry with said slot, an inclined tapered camming surface at said spring blade free end facilitating introduction of said tongue member between said free ends and deflecting one of said spring blades in one direction and the other of said spring blades in an opposite direction for causing one of said spring blades to engage said tongue member on one side and the other to engage said tongue member on the other side when deflected in said opposite directions with said tongue member introduced through said slot.

2. The coupling of claim 1 wherein said T-shaped member is disposed in a cavity at said end of said male member, said cavity having an internal diameter slightly larger than the peripheral diameter of said female member.

3. The coupling of claim 1 wherein said cavity in said female member has a first internal projection abutting one of said spring blades upon deflection for limiting the deflection thereof, and a second projection disposed substantially 90° away from said first projection limiting the rotation of said T-shaped member away from said slot when in a locked position, said T-shaped member being disposed in the space between said spring blades.

4. The coupling of claim 1 further comprising means for attaching the end of a link to said male and female member.

* * * * *

UNITED STATES PATENT AND TRADEMARK OFFICE

CERTIFICATE OF CORRECTION

PATENT NO. : 4,184,232

DATED : January 22, 1980

INVENTOR(S) : Andre Marosy

It is certified that error appears in the above-identified patent and that said Letters Patent are hereby corrected as shown below:

Column 2, line 53, change "40" to --39--.

Column 4, line 23, change "againstthe" to --against the--.

Signed and Sealed this

*Fifteenth* Day of *April 1980*

[SEAL]

*Attest:*

SIDNEY A. DIAMOND

*Attesting Officer*

*Commissioner of Patents and Trademarks*